United States Patent [19]

Carithers, Jr.

[11] Patent Number: 4,798,118

[45] Date of Patent: Jan. 17, 1989

[54] APPARATUS FOR CUTTING V-GROOVES IN MATS

[76] Inventor: Charles H. Carithers, Jr., 5752 A Gallant Dr., Jackson, Miss. 39239

[21] Appl. No.: 161,042

[22] Filed: Feb. 26, 1988

[51] Int. Cl.[4] ..... B26D 3/06; B27M 1/00

[52] U.S. Cl. ..... 83/875; 83/564; 83/698; 144/136 R; 144/371

[58] Field of Search ..... 83/875, 877, 698, 563, 83/564; 144/2 R, 3 R, 136 R, 371

[56] References Cited

U.S. PATENT DOCUMENTS

| | | | |
|---|---|---|---|
| 3,672,415 | 6/1972 | Holan | 144/136 R |
| 3,875,835 | 4/1975 | Roberts | 144/136 R |
| 3,967,519 | 7/1976 | Esterly | 83/879 |
| 4,083,390 | 4/1978 | Ingham | 83/875 |
| 4,342,349 | 8/1982 | Lipman | 83/875 |

*Primary Examiner*—W. Donald Bray
*Attorney, Agent, or Firm*—Larson and Taylor

[57] ABSTRACT

A cutting unit and associated mat cutting apparatus are provided for cutting V-grooves in a mat board or the like. The cutting unit is mounted on a mat cutter and includes a pair of cutting blade holders attached to a frame. Each blade holder mounts a cutting blade therein with an exposed tip. The blade holders are movable between a lowered position relative to frame where the tips are adjacent one another and form a V pattern which intersects the mat board and a raised position. The cutting unit is mounted for precise movement along the guide of the mat cutter whereby a V-groove is precisely cut during movement as the cutting blade holders are held in the lowered position. Preferably, the blade holders are biased to the raised position and a retaining device is provided for retaining the blade holders in a lowered position, preferably locked in a lowered position. The tips of the blade are also preferably offset longitudinally relative to one another.

25 Claims, 3 Drawing Sheets

10
12
14
16
18
20
22
24
26
28
30
32
34
36
38
40
42
44
46
48
50
52
54
56
58
60
62
66
70
72
80
96
100
102
104
106
108
110
112
114
116
F

APPARATUS FOR CUTTING V-GROOVES IN MATS

FIELD OF THE INVENTION

The present invention relates generally to an apparatus for cutting V-grooves in picture mat boards or the like, and more particularly to an apparatus which precisely and conveniently cuts a V-groove in a mat board in one stroke.

BACKGROUND OF THE INVENTION

When providing a mat board for a picture, it is frequently desired to add a decorative V-groove or the like about the picture in the mat board. The creation of such V-grooves is a difficult and time-consuming task.

One manner in which V-grooves can be provided is to use a mat cutter having a bevelled cutting blade movably mounted on a cutting guide disposed adjacent an associated mat guide. Using the bevel cutting head, a regular bevelled opening is cut in the mat. Then, the fallout piece is placed in the mat cutter and the bevelled cutting blade is used to trim approximately 1/16 inch off of each side. The fallout piece is then reinserted in the mat and tape is applied to the back of the fallout piece and mat to hold the fallout piece in place. Depending on the accuracy of the mat cutting apparatus, an attractive and fairly consistent V-groove is created in a mat in this manner. However, such a system for creating V-grooves requires a precise mat cutting system, as well as being relatively time consuming and subject to simple errors which can ruin the entire job.

SUMMARY OF THE INVENTION

In accordance with the present invention, an apparatus is provided for cutting V-grooves in a mat board or the like simply and easily. The apparatus includes a mat cutter having a flat base as well as a positioning means for positioning the mat board on the base. The cutting apparatus is provided with a guide which is mounted to the flat base adjacent the positioning means. A cutting unit is suitably mounted on the guide by a frame mounting means. The cutting unit includes a frame and a pair of cutting blade holders. Each cutting blade holder has a cutting blade positioned therein with an exposed tip. A holder moving means is provided on the frame for moving the blade holders between a lowered position relative to the frame where the tips are immediately adjacent one another and the planes of the blades intersect at the tips to form a V-pattern and a raised position relative to the frame. Thus, a V-groove is precisely cut in the mat board provided on the base when the cutting unit is moved along the guide and the holder moving means is moved to the lowered position so that the tips engage the mat board.

In the preferred embodiment, the holder moving means includes a holder mounting means for mounting each blade holder to the frame for rotation about a respective axis. Thus, the tips of the cutting blades are rotatable with the blade holders from the raised position to the lowered position where the tips are adjacent one another. In addition, the holder moving means includes a biasing means for biasing the blade holders about the respective axes of rotation to the raised position. A retaining means has been provided for retaining the blade holder means in the lowered position, such as a lock means which locks the holding means in the lowered position. The retaining means includes a lever, a pivot means for mounting the lever to the frame for rotation about an axis, and an engaging means attached to the lever for engaging the blade holders as the lever is rotated about the axis to move the blade holders from the raised position to the lowered position. Preferably, the engagement between the engaging means and the blade holders creates a moment about the pivot means due to the action of the biasing means. The lock means is then provided by positioning the axis of the pivot means to a side of the moment created by the biasing means when the blade holders are in the lowered position. This causes the moment to urge the lever to continue lowering the blade holders against a stop means provided for preventing the continued lowering of the blade holders when the blade holders are in the lowered position.

In mounting the blade holders to the frame, it is also preferred that one of the tips of the blade is offset from the other tip in a longitudinal direction relative to the V-groove which is cut. With such an offset, the leading tip provided by such an offset is preferably used for the inside cut of the V. Then, when a corner is cut, the outside, trailing blade is moved the full length of the cut resulting in a slight overcut of the inside leading blade. However, when the mat is turned 90° and the second V cut is made at the corner, an exact cut is made at the corner and most of the overcut of the inside of the V is cut off by the subsequent cut made by the outside blade in the new V-groove. The small remaining cut portion which is not removed by the subsequent V-groove is so small as to be unnoticeable.

In the preferred embodiment, the guide includes a flat guide bar having a top surface and a guide rod attached to the top surface. The frame mounting means then includes a pair of frame portions on one side of the blade holders, with each frame portion including an aperture in which the guide rod is snuggly but slidably received. These frame portions also include bearing surfaces on either side of the aperture which slide along the top surface of the guide bar. Preferably, these bearing surfaces are individually adjustable in a direction perpendicular to the guide bar so that the depth and breadth of the V-groove is thereby adjustable. In addition, each frame portion includes two elements each of which forms a part of the aperture. An attaching means is then provided for attaching the two elements together to form the aperture in which the guide rod is snuggly received. With the attaching means, each frame portion and hence the frame are quickly and easily attachable and demountable from the guide rod.

To provide for an easier making of the V-grooves, guide stops are preferably provided adjustably along the guide on respective sides of the cutting unit. The cutting unit then includes adjustable stop members on respective sides of the frame for engagement with these guide stops.

It is an object of the present invention to provide an apparatus for cutting V-grooves which is simple to operate and which is easily used to cut V-grooves in a mat board to form a rectangular or other pattern.

It is also an object of the present invention to provide an apparatus for cutting V-grooves in which the depth and hence breadth of the V-groove is easily adjusted.

Other features and objects of the present invention are stated in or apparent from a detailed description of a presently preferred embodiment of the invention found hereinbelow.

DETAILED DESCRIPTION OF THE PREFERRED EMBODIMENT

Figures 1, 2, 4:
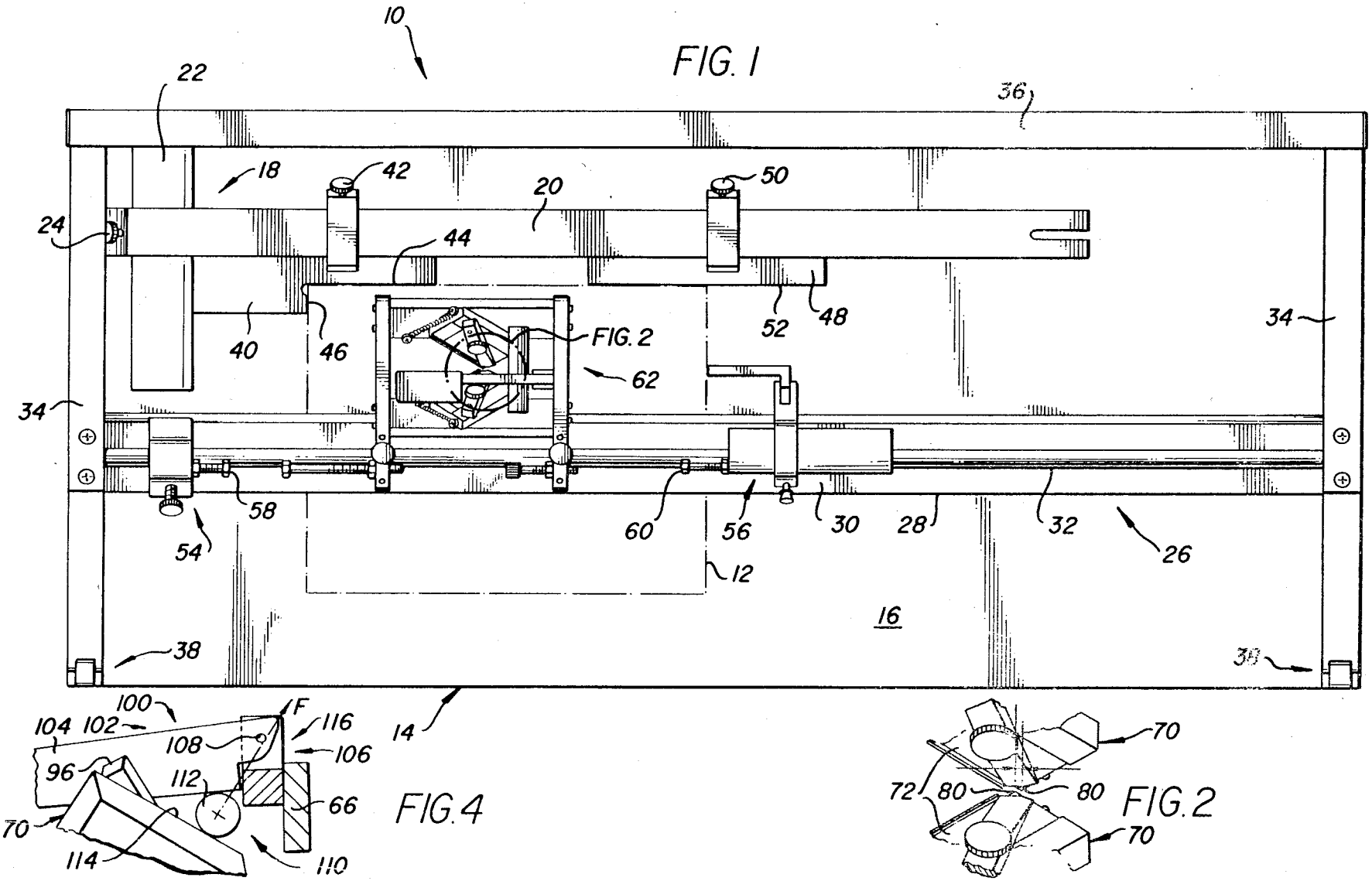
FIG. 1 is a top plan view of an apparatus according to the present invention for cutting V-grooves in a mat board including a cutting unit.
FIG. 2 is an enlarged view of a portion of the cutting unit depicted in FIG. 1.
FIG. 4 is a side elevation view of a portion of the cutting unit depicted in FIG. 3.

With reference now to the drawings in which like numerals represent like elements throughout the several views, an apparatus 10 for cutting V-grooves in a mat board 12 or the like is depicted in FIG. 1. In this embodiment of the present invention, apparatus 10 includes a C & H Mat Cutter 14 available from C & H Manufacturing of Jackson, Miss. Mat cutter 14 includes a flat base 16 upon which mat board 12 rests. Mat cutter 14 also includes a positioning means 18 for precisely positioning mat board 12 on flat base 16. Positioning means 18 has a mat guide bar 20 which is mounted on a mounting arm 22. Mat guide bar 20 is perpendicular to mounting arm 22 and is adjustably mounted thereon by means of thumbscrew 24.

Positioning means 18 positions mat board 12 on flat base 16 relative to a guide 26. Guide 26 includes a guide bar 28 having a top surface 30 and a guide rod 32 attached to top surface 30. Guide 26 is mounted for movement forward and away from flat base 16 by means of a pair of parallel supports 34 attached together by a handle 36. Supports 34 are pivotably attached to flat base 16 by hinges 38 at one side of flat base 16 so that guide 26 is easily raised above flat base 16 by grasping handle 36. This movement of guide 26 facilitates the insertion and removal of mat board 12 on a flat base 16.

In order to easily cut V-grooves immediately adjacent the edges of mat board 12, positioning means 18 also preferably includes a first attachment 40 which is removably and adjustably located on mat guide bar 20 by a thumbscrew 42. As shown, first attachment 40 includes an edge 44 parallel to mat guide bar 20 against which an edge of mat board 12 rests. First attachment 40 also includes a second edge 46 parallel to mounting arm 22 which acts as a stop against which mat board 12 rests. To assure the parallel alignment of the edge of mat board 12 against edge 44, a second attachment 48 is provided on mat guide bar 20 by use of thumbscrew 50. Second attachment 48 includes an edge 52 which is spaced the same distance from mat guide bar 20 as edge 44 of first attachment 40. Thus, by positioning the edge of mat board 12 against both edges 44 and 52, mat board 12 is precisely positioned with an edge parallel to mat guide bar 20 and precisely positioned a distance away from mounting arm 22 by edge 46. Attachments 40 and 48 further allow the easy use of adjustable stops 54 and 56 which are conveniently mounted on cutter guide rod 32. As is known to those of ordinary skill in the art, stops 54 and 56 include adjustable stop ends 58 and 60.

Figure 3:
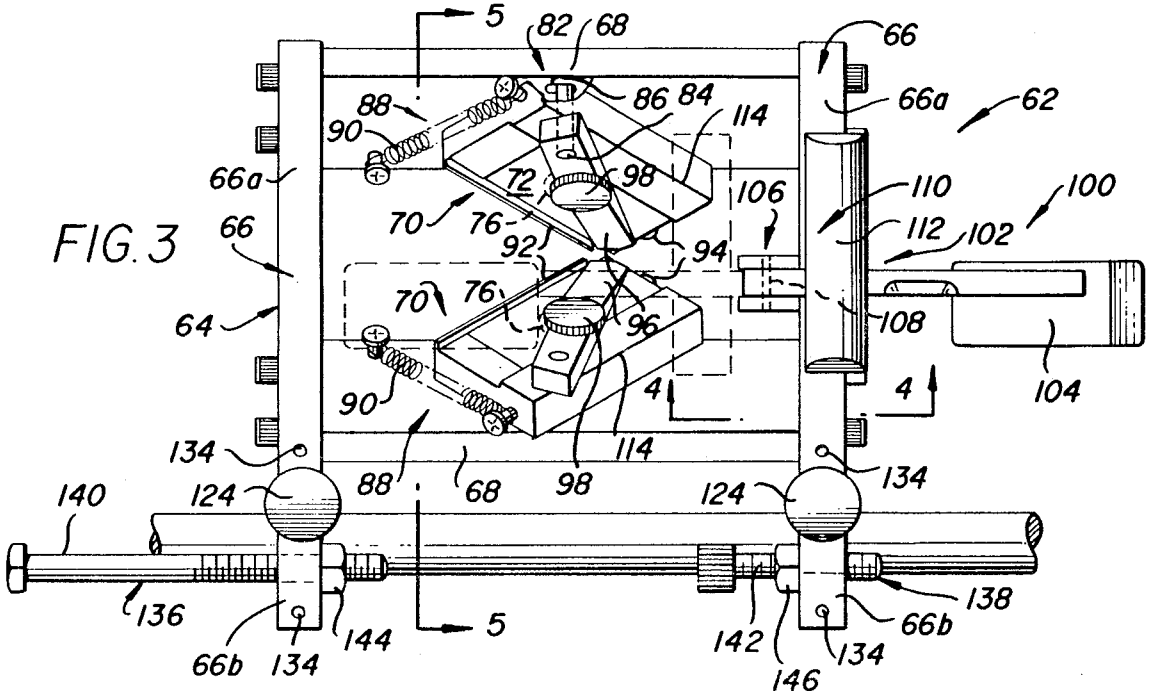
FIG. 3 is a top plan view of the cutting unit depicted in FIG. 1 showing greater detail.

As shown in greater detail in FIG. 3, apparatus 10 includes a cutting unit 62 which is mounted for movement along cutter guide 26. Cutting unit 62 includes a frame 64 comprising two mounting arms 66 and two cross pieces 68 which are mounted to form a suitable angle between each other for a V-groove, such as approximately 75°. As shown further in FIG. 5, each cross piece 68 has a cutting blade holder 70 attached thereto in which a cutting blade 72 is provided. Each cutting blade holder 70 is mounted to cross piece 68 by a holder mounting means 74 for rotation about a respective axis. Conveniently, holder mounting means 74 is a screw 76 which is threadably received in cross piece 68 and which includes a shank 78 about which cutting blade holder 70 rotates.

Figure 6:
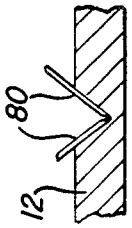
FIG. 6 is an enlarged view of the cutting of the mat board depicted in FIG. 5.

Cutting blade holder 70 is constrained to rotate between a raised position where tips 80 of cutting blade 72 are raised out of engagement with mat board 12 and a lowered position where tips 80 penetrate into mat board 12 as depicted in FIG. 6. The movement of cutting blade holder 70 is depicted schematically in FIG. 5 as a difference between the solid lines shown for cutting blade holder 70 in the lowered position and the dotted lines outlining a portion of cutting blade holder 70 in the raised position. Each cutting blade holder 70 is constrained to move only between the raised and lowered position by means of a stop means 82. Conveniently, stop means 82 takes the form of a pin 84 extending through cutting blade holder 70 and into a curved slot 86 precisely positioned in cross piece 68. Thus, pin 84 is constrained to move only between the ends of slot 86. Preferably, a biasing means 88 is provided to bias cutting blade holder 70 to the raised position when pin 84 engages an end of slot 86. Biasing means 88 is preferably a spring 90 attached at one end to cross piece 68 and at the other end to cutting blade holder 70 as shown. As an alternative, a stop screw can be provided adjacent a top edge of cutting blade holder 70.

It should be appreciated that cutting blades 72 are precisely located in cutting blade holder 70 by means of a lower edge stop 92 and end stops 94. In addition, cutting blade 72 is firmly held in cutting blade holder 70 by a pressing member 96 having a thumbscrew 98 for adjustment which allows the insertion removal of cutting blade 72. Pressing member 96 has an end adjacent tips 80 to reinforce tips 80. The end of pressing member 96 is always aligned in this position because pin 84 also passes through pressing member 96 as shown.

It should further be appreciated that cutting blade holders 70 are precisely positioned on respective cross pieces 68 so that one cutting blade holder 70 is slightly offset in a direction along cutter guide 26 from the other. This results in one tip 80 being slightly offset from the other tip 80 along the length of cutter guide 26 by a short distance as depicted in FIG. 2. Preferably, this distance is approximately 1/32 inch and cutting blade holder 70 closest to mat guide bar 20 is the cutting blade holder slightly behind (in the cutting direction) of the other cutting blade holder 70. This offset of tips 80 allows for an easier cutting of a corner where two V-grooves meet, as explained subsequently.

In order to move cutting blade holder 70 between the raised and lowered position about holder mounting means 74, a holder moving means 100 is provided. Holder moving means 100 includes a retaining means 102 which is used to retain cutting blade holders 70 in the lowered position. Retaining means 102 preferably includes a lever 104 which is mounted to mounting arm 66 as shown by a pivot means 106 including a pin 108. Attached to lever 104 is an engaging means 110 which preferably takes the form of short steel rod 112.

As shown best in FIG. 4, steel rod 112 engages an edge 114 of each cutting blade holder 70 to move cutting blade holder 70 from the raised position to the lowered position within the limits of stop means 82. The use of lever 104 makes it easier to overcome the biasing of biasing means 88 which pulls cutting blade holder 70 to the raised position. However, it should also be appreciated that holder moving means 100 further includes a lock means 116 for locking retaining means 102 in the position where cutting blade holder 70 are in the lowered positioned. Lock means 116 is provided by the location of pin 108 to one side of the force line F created by biasing means 88 acting through cutting blade holder 70 and steel rod 112. As shown in FIG. 4, force line F is located below pin 108. Therefore, a moment is created about pin 108 which urges, slightly, lever 104 toward the lowered position and hence to the position where pin 84 and stop means 82 engages the end of slot 86. In this lowered position, biasing means 82 thus holds or locks lever 104 in the lowered position by the action of the moment created by biasing means 82. Obviously, as lever 104 is raised slightly, force line F shifts to the other side of pin 108 and lever 104 is thus urged upwards by biasing means 82 and biasing means 82 thus completes raising of cutting blade holder 70. The raised and lowered position of lever 104 and the rest of retaining means 102 is depicted schematically by dotted lines in FIGS. 3 and 5.

Figure 5:
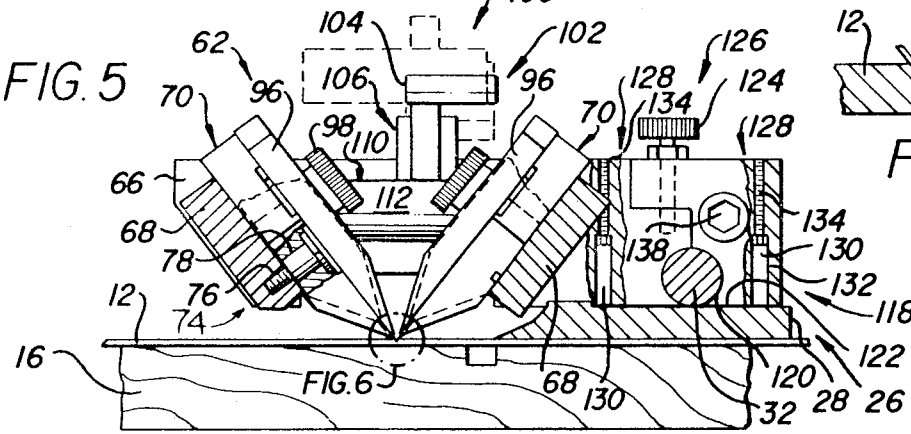
FIG. 5 is a cross sectional front elevation view of the cutting unit depicted in FIG. 4.

In order to facilitate the mounting of cutting unit 62 on cutter guide 26, a frame mounting means 118 is provided. Frame mounting means 118 includes an aperture 120 in each mounting arm 66 as shown best in FIG. 5. Frame mounting means 118 further includes a bottom bearing surface of each mounting arm 66 which mates with top surface 30 of cutter guide bar 28. As is also shown in FIG. 5, mounting arm 66 includes two elements 66*a* and 66*b* which together form aperture 120 and which have mating surfaces as shown. A thumbscrew 124 passes through element 66*b* and is threadably received in element 66*a* to securely attached elements 66*a* and 66*b* together. Thus, it will be appreciate that cutting unit 62 is simply mounted on cutter guide 26 by initially removing element 66*b* from mounting arm 66 so that the remainder of cutting unit 62 is easily placed on cutter guide 26 with cutter guide rod 32 received in the half of aperture 120 in element 66*a*. Then, element 66*b* is attached to element 66*a* to complete the attachment of cutting unit 62 to cutter guide 26 in the trapping of cutter guide rod 32 in aperture 120. Thus, aperture 120 and element 66*a* and 66*b* together with thumbscrew 124 form a suitable attaching means 126 for attaching cutting unit 62 to cutter guide 26.

As also shown in FIG. 5, mounting arm 66 also includes an adjustment means 128 for adjusting the position of cutting unit 62 on cutter guide 26. Adjusting means 128 includes a pair of polymeric rods 130 which are disposed in suitable apertures 132 located on either side of aperture 120. The extent, if any, by which polymeric rods 130 extend below bottom bearing surface 122 of mounting arm 66 is adjustable by means of respective set screws 134. Thus, if cutting unit 62 is slightly loosely fitted on cutter guide 26, set screws 134 can be suitably adjusted to extend polymeric rods 130 out of mounting arm 66 to achieve a tight sliding fit of cutting unit 62 to cutter guide 26. It should also be appreciated that adjustment means 128 provides for a slight adjustment of the depth of cut of tips 80 in mat board 12. As will be appreciated with reference to FIG. 5, where polymeric rods 130 on the side of cutter guide rod 32 closest to tips 80 are adjusted to extend from mounting arm 66, tips 80 will be raised slightly relative to mat board 12. On the other hand, where polymeric rods 130 on the other side of cutter guide rod 32 are extended from bottom bearing surface 122 of mounting arm 66, tips 80 will be lowered somewhat into mat board 12. While it is contemplated that such an adjustment of the depth of the V-groove cut by tips 80 will not generally be needed, it should be appreciated that adjustment means 128 does provide this additional possibility.

Cutting unit 62 also includes adjustable stops 136 and 138. Adjustable stops 136 and 138 include respective threaded bolts 140 and 142 which are threadably received in a respective mounting arm 66 and which extend outwardly from cutting unit 62. Bolts 140, 142 are held in place after threaded adjustment by respective nuts 144 and 146 which engage the associated mounting arm 66. Adjustable stops 136 and 138 are designed to engage respective stops 54 and 56 on cutter guide bar 32 and thus to provide very precise cutting strokes along cutter guide 26 as desired.

In operation, cutting unit 62 functions in the following manner after attachment to mat cutter 14. Where stops 54 and 56 are not to be used, it is a simple matter to initially mark mat board 12 in pencil where it is desired to have a V-groove cut. Then, by appropriate positioning of positioning means 18, cutting unit 62 is used to cut the V-groove along one penciled line. It should be noted that cutting unit 62 is initially located at the end of the line furthest from mounting arm 22. At this position, holder moving means 100 is used to move cutting blade 72 from the raised position to the lowered position where tips 80 penetrate mat board 12. This is simply done by moving lever 104 around pivot means 106 until lever 104 will no longer move due to the action of pin 84 contacting the end of slot 86. Cutting unit 62 is then manually drawn toward mounting arm 22 the desired distance at which time lever 104 is raised and tips 80 are withdrawn from mat board 12. The remaining cuts are then made in mat board 12 as appropriate.

If stops 54 and 56 are used with mat cutter 14, it is also possible to provide for over cuts or under cuts where desired using cutting unit 62 without changing the position of stops 54 and 56. This is simply done by use of adjustable stops 136 and 138 by loosening the appropriate bolt 144, 146 and either advancing or retreating respective bolt 140 or 142 to the desired over cut or under cut position.

Figure 7:
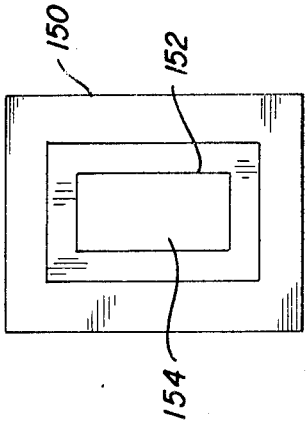
FIGS. 7 and 8 are examples of V-grooves which can be cut in a mat board with the present invention.
Figure 8:
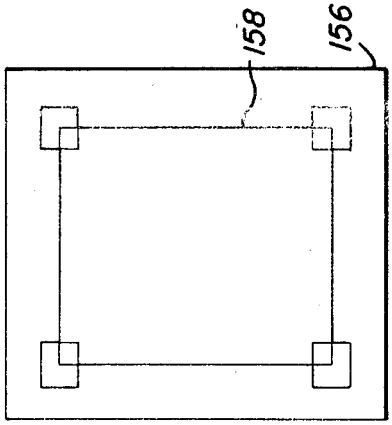

Depicted in FIGS. 7 and 8 are two of many different examples of V-groove patterns which can be cut in a mat board by apparatus 10. In FIG. 7, a mat board 150 is shown in which a rectangular V-groove 152 has been cut around an opening 154. In FIG. 8, a more elaborate design of V-grooves is shown in a mat board 156. Mat board 156 has a keystone corner V-groove pattern 158 which is easily cut using detachable stops 54 and 56.

Figure 9:
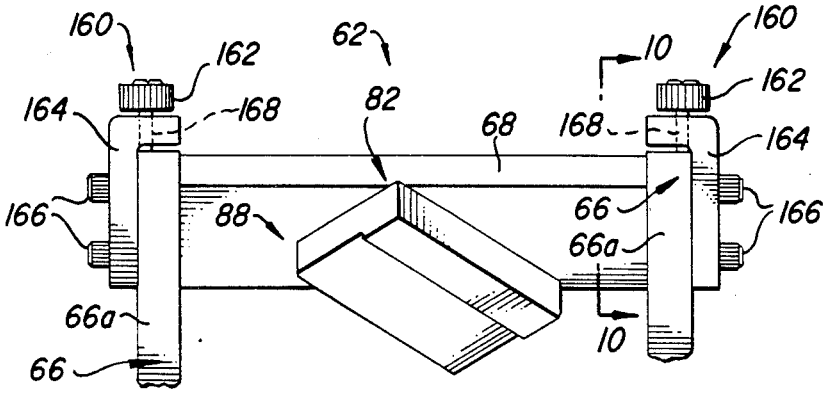
FIG. 9 is a schematic top plan view of a portion of the cutting unit of the present invention provided with a stabilizing attachment.
Figure 10:
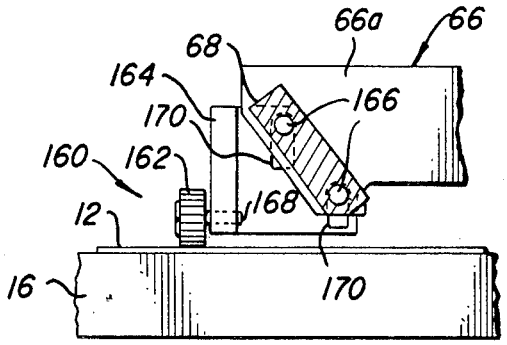
FIG. 10 is a schematic side elevation of the stabilizing attachment taken along the line 10—10 in FIG. 9.

Depicted in FIGS. 9 and 10 is a stabilizing means 160 for cutting unit 62. As shown, stabilizing means 160 comprises two rollers 162 which are mounted to respective brackets 164. Each bracket 164 is mounted to a respective element 66a of mounting arm 66 by screws 166 which are normally used to mount cross piece 68 to respective element 66a. Rollers 162 are mounted to brackets 164 by suitable axles 168.

In order to accommodate different size mat boards, stabilizing means 160 is adjustable to raise or lower the height of rollers 162 above flat base 16. This is accomplished by use of slots 170 which are provided in each bracket 164 and through which screws 166 extend. Thus, by loosening screws 166, the height of each roller 162 is adjustable as desired. After adjustment, screws 166 are tightened to hold bracket 164 in the adjusted position.

When stabilizing means 160 is attached to cutting unit 62 and adjusted, as shown in FIG. 10, rollers 162 ride along mat board 12 as cutting unit 62 is moved along cutter guide rod 32 and cutter guide bar 28. As stabilizing means 160 is provided at the end of cutting unit 62 furthest from the support provided by cutter guide bar 28 and cutter guide rod 32, the ends of elements 66a are thus stabilized as rollers 162 ride along mat board 12 during cutting. This results in stabilizing the movement of cutting unit 62 and thus a smoother movement which results in better control of the width and depth of the V-groove being cut.

Although the present invention has been described with respect to an exemplary embodiment thereof, it will be understood by those of ordinary skill in the art that variations and modifications can be effected within the scope and spirit of the invention.

I claim:

1. An apparatus for cutting V-grooves in a mat board or the like comprising:

a flat base;

a positioning means for positioning the mat board on said base;

a cutting unit, said cutting unit including (a) a frame, (b) a pair of cutting blade holders, each said blade holder having a cutting blade positioned therein with an exposed tip, and (c) a holder moving means attached to said frame for moving said blade holders between lowered position relative to said frame where said tips are adjacent one another while planes of said blade intersect at the tips to form a V-pattern and a raised position relative to said frame;

a guide mounted to said base adjacent said positioning means; and a frame mounting means for mounting said frame of said cutting unit for precise movement along said guide whereby a V-groove is precisely cut in the mat board positioned by said positioning means when said cutting unit is moved along said guide and said holder moving means is moved to the lowered position where said tips engage the mat board.

2. An apparatus for cutting V-grooves as claimed in claim 1 wherein said holder moving means includes a holder mounting means for mounting each said blade holder to said frame for rotation about a respective axis whereby said tips of said cutting blades are rotatable with said blade holders from the raised position to the lowered position where said tips are adjacent one another.

3. An apparatus for cutting V-grooves as claimed in claim 2 wherein said holder moving means further includes a biasing means for biasing said blade holders about the respective axes of rotation to the raised position.

4. An apparatus for cutting V-grooves as claimed in claim 3 wherein said holder moving means further includes a retaining means for retaining said blade holders in the lowered position.

5. An apparatus for cutting V-grooves as claimed in claim 4 wherein said retaining means includes a lock means for locking said retaining means in the lowered position.

6. An apparatus for cutting V-grooves as claimed in claim 5 wherein said retaining means includes a lever, a pivot means for mounting said lever to said frame for rotation about an axis, and an engaging means attached to said lever for engaging said blade holders to move said blade holders from the raised position to the lowered position as said lever is rotated about said pivot means.

7. An apparatus for cutting V-grooves as claimed in claim 6 wherein the engagement between said engaging means and said blade holders creates a moment about said pivot means due to the action of said biasing means, and wherein said lock means is provided by positioning the axis of said pivot means to a side of the moment caused by said biasing means when said blade holders are in the lowered position which causes the moment to urge said lever to continue lowering said blade holders; and further including a stop means for preventing the continued lowering of said blade holders when said blade holders are in the lowered position.

8. An apparatus for cutting V-grooves as claimed in claim 2 wherein said holder mounting means mount said blade holders such that one said tip is offset from the other said tip in a longitudinal direction relative to the V-groove which is cut.

9. An apparatus for cutting V-grooves as claimed in claim 1 wherein said guide includes a flat guide bar having a top surface and a guide rod attached to said top surface; and wherein said frame mounting means includes a pair of frame portions on one side of said blade holders, each said frame portion including an aperture in which said guide rod is snuggly but slidably received and bearing surfaces on either side of said aperture which slide along said top surface of said guide bar.

10. An apparatus for cutting V-grooves as claimed in claim 9 wherein said frame mounting means further includes an adjustment means for individually adjusting the positions of said bearing surfaces relative to said frame in a direction perpendicular to said guide bar whereby the depth and breadth of the V-groove is adjustable.

11. An apparatus for cutting V-grooves as claimed in claim 10 wherein each said frame portion includes two elements, each of which said elements forms a part of said aperture, and an attaching means for removably attaching said two elements together to form said aperture in which said guide rod is snuggly received whereby said frame portion is easily mounted on said guide rod.

12. An apparatus for cutting V-grooves as claimed in claim 1 and further including guide stops adjustably located along said guide on respective sides of said cutting unit, and wherein said cutting unit includes adjustable stop members on respective sides of said frame which engage respective guide stops.

13. A cutting unit for cutting V-grooves in a mat board located on a mat cutter having a guide comprising:

a frame;

a pair of cutting blade holders attached to said frame, each said blade holder mounting a cutting blade therein with an exposed tip;

a holder moving means attached to said frame for moving said blade holders between a lowered position relative to said frame where said tips are adjacent one another while planes of the blades intersect at the tips to form a V-pattern and a raised position relative to said frame; and a frame mounting means for mounting said frame for precise movement along the guide of the mat cutter whereby a V-groove is precisely cut in the mat board on the mat cutter when said frame is moved along the guide and said holder moving means is moved to the lowered position where the tips engage the mat board.

14. A cutting unit as claimed in claim 13 wherein said holder moving means includes a holder mounting means for mounting each said blade holder to said frame for rotation about a respective axis whereby the tips of the cutting blades are rotatable with said blade holders from the raised position to the lowered position where the tips are adjacent one another.

15. A cutting unit as claimed in claim 14 wherein said holder mounting means mount said blade holders such that one tip is offset from the other tip in a longitudinal direction relative to the V-groove which is cut.

16. A cutting unit as claimed in claim 15 wherein said holder moving means further includes a biasing means for biasing said blade holders about the respective axes of rotation to the raised position.

17. A cutting unit as claimed in claim 16 wherein said holder moving means further includes a retaining means for retaining said blade holders in the lowered position.

18. A cutting unit as claimed in claim 17 wherein said retaining means includes a lock means for locking said retaining means in the lowered position.

19. A cutting unit as claimed in claim 18 wherein said retaining means includes a lever, a pivot means for mounting said lever to said frame for rotation about an axis, and an engaging means attached to said lever for engaging said blade holders to move said blade holders from the raised position to the lowered position as said lever is rotated about said pivot means.

20. A cutting unit as claimed in claim 19 wherein the engagement between said engaging means and said blade holders creates a moment about said pivot means due to the action of said biasing means, and wherein said lock means is provided by positioning the axis of said pivot means to a side of the moment caused by said biasing means when said blade holders are in the lowered position which causes the moment to urge said lever to continue lowering said blade holders; and further including a stop means for preventing the continued lowering of said blade holders when said blade holders are in the lowered position.

21. A cutting unit as claimed in claim 20 wherein the guide includes a flat guide bar having a top surface and a guide rod attached to the top surface; and wherein said frame mounting means includes a pair of frame portions on one side of said blade holders, each said frame portion including an aperture in which the guide rod is snuggly but slidably received and bearing surfaces on either side of said aperture which slide along the top surface of the guide bar.

22. A cutting unit as claimed in claim 21 wherein said frame mounting means further includes an adjustment means for individually adjusting the positions of said bearing surfaces relative to said frame in a direction perpendicular to the guide bar whereby the depth and breadth of the V-groove is adjustable.

23. A cutting unit as claimed in claim 22 wherein each said frame portion includes two elements each of which said elements forms a part of said aperture, and an attaching means for removably attaching said two elements together to form said aperture in which the guide rod is snuggly received whereby said frame portion is easily mounted on the guide rod.

24. An apparatus for cutting V-grooves as claimed in claim 9 wherein said frame portions extend to the other side of said blade holders and wherein said frame mounting means further includes a stabilizing means attached to said frame portions on the other side of said blade holders for engaging the mat board during movement of said cutting unit to stabilize the positions of said frame portions above the mat board.

25. A cutting unit as claimed in claim 21 wherein said frame portions extend to the other side of said blade holders and wherein said frame mounting means further includes a stabilizing means attached to said frame portions on the other side of said blade holders for engaging the mat board during movement of said frame to stabilize the positions of said frame portions above the mat board.

* * * * *